US009050223B2

(12) United States Patent
Ohta et al.

(10) Patent No.: US 9,050,223 B2
(45) Date of Patent: Jun. 9, 2015

(54) LIFTING APPARATUS AND BED PROVIDED WITH THE SAME

(71) Applicant: Panasonic Corporation, Osaka (JP)

(72) Inventors: Akihiro Ohta, Osaka (JP); Shohei Tsukada, Hyogo (JP); Yohei Kume, Osaka (JP); Tomohiro Shimoda, Tokyo (JP); Hideo Kawakami, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/081,248

(22) Filed: Nov. 15, 2013

(65) Prior Publication Data

US 2014/0137328 A1 May 22, 2014

(30) Foreign Application Priority Data

Nov. 16, 2012 (JP) ..... 2012-251750
Oct. 17, 2013 (JP) ..... 2013-216144

(51) Int. Cl.

| | |
|---|---|
| ***A61G 7/12*** | (2006.01) |
| ***B66F 7/06*** | (2006.01) |
| ***A61G 7/018*** | (2006.01) |
| ***A61G 7/012*** | (2006.01) |
| ***A61G 7/015*** | (2006.01) |
| ***A61G 7/10*** | (2006.01) |
| ***A61G 7/16*** | (2006.01) |
| *A61G 7/053* | (2006.01) |
| *A61G 7/05* | (2006.01) |

(52) U.S. Cl.

CPC ..... *A61G 7/018* (2013.01); *A61G 7/012* (2013.01); *B66F 7/0691* (2013.01); *A61G 7/015* (2013.01); *A61G 7/053* (2013.01); *A61G 7/1019* (2013.01); *A61G 7/1046* (2013.01); *A61G 7/1057* (2013.01); *A61G 7/16* (2013.01); *A61G 2007/0518* (2013.01); *A61G 2007/0524* (2013.01); *A61G 2203/14* (2013.01)

(58) Field of Classification Search

CPC ..... A61G 7/018; A61G 7/012; A61G 7/015; A61G 7/053; A61G 7/1019; A61G 7/1046; A61G 7/1057; A61G 7/16; A61G 2007/0518; A61G 2007/0524; A61G 2203/14; B66F 7/0691

USPC ..... 5/611, 11, 86.1, 610, 616, 109, 613, 5/618, 617, 600; 254/160

See application file for complete search history.

(56) References Cited

U.S. PATENT DOCUMENTS 5,303,437 A * 4/1994 Hung ..... 5/613
5,365,622 A * 11/1994 Schirmer ..... 5/611
5,404,603 A * 4/1995 Fukai et al. ..... 5/609
5,720,059 A * 2/1998 Allevato et al. ..... 5/610

(Continued)

FOREIGN PATENT DOCUMENTS

JP 7-8481 1/1995

*Primary Examiner* — Peter M Cuomo
*Assistant Examiner* — Brittany Wilson
(74) *Attorney, Agent, or Firm* — Wenderoth, Lind & Ponack, L.L.P.

(57) ABSTRACT

A lifting apparatus includes an upper frame, a base frame, a link mechanism for connecting the upper frame and the base frame, and a linear actuator connected to the link mechanism for driving the link mechanism. The link mechanism includes at least a T-shaped first arm slidably supported on the base frame or the upper frame and provided with connections at four points, and an L-shaped second arm provided with connections at three points.

15 Claims, 6 Drawing Sheets

(56) References Cited

U.S. PATENT DOCUMENTS

| | | | | |
|---|---|---|---|---|
| 6,161,236 | A * | 12/2000 | Carroll | 5/618 |
| 6,493,886 | B1 * | 12/2002 | Vanpage et al. | 5/118 |
| 6,505,362 | B1 * | 1/2003 | Scipio | 5/118 |
| 6,851,144 | B2 * | 2/2005 | Wang | 5/610 |
| 7,373,677 | B2 * | 5/2008 | Barthelt | 5/618 |
| 7,451,505 | B2 * | 11/2008 | Johannsen | 5/607 |
| 7,849,538 | B1 * | 12/2010 | Edgerton | 5/611 |
| 8,321,976 | B1 * | 12/2012 | Edgerton | 5/611 |
| 2004/0055087 | A1 * | 3/2004 | Edgerton | 5/611 |
| 2007/0067912 | A1 * | 3/2007 | Lemire | 5/611 |
| 2009/0038074 | A1 * | 2/2009 | Barthelt | 5/611 |
| 2010/0017965 | A1 * | 1/2010 | Barthelt | 5/611 |
| 2010/0064441 | A1 * | 3/2010 | Barthelt | 5/616 |

* cited by examiner

LIFTING APPARATUS AND BED PROVIDED WITH THE SAME

BACKGROUND OF THE INVENTION

The present invention relates to a lifting apparatus for converting a linear action by a linear actuator into a linear action in a different direction, and a bed provided with the same.

There is a lifting apparatus for linearly lifting and lowering a heavy item (for example, refer to Patent Literature 1 (JP 7-8481 A)). This lifting apparatus is formed by, for example, a linear actuator including an excellent thrust force and an X-shaped link structure.

FIG. 6 shows a configuration view of the conventional lifting apparatus described in Patent Literature 1.

As shown in FIG. 6, a lifting apparatus 70 is formed by a foundation 71, a top plate 72, linear arms 74, 76, and a linear actuator 77. One end of the linear arm 74 is rotatably connected to the foundation 71, and the other end is connected slidably in a groove 73 of the top plate 72. One end of the linear arm 76 is rotatably connected to the top plate 72, the other end is connected slidably in a groove 75 of the foundation 71, and a center part is rotatably connected to the linear arm 74. One end of the linear actuator 77 is connected to the foundation 71, and the other end is connected to the linear arm 76. This lifting apparatus 70 is a mechanism of lifting and lowering the top plate 72 vertically with respect to the foundation 71.

SUMMARY OF THE INVENTION

An object of the present invention is to provide a lifting apparatus in which a load applied to an actuator is as constant as possible without depending on a distance between an upper frame (top plate) and a base frame (foundation), and a bed provided with the same.

In accomplishing these and other aspects, according to one aspect of the present invention, there is provided a lifting apparatus comprising a link mechanism lifting and lowering an upper frame with respect to a base frame, wherein the link mechanism comprises:

a first arm slidably supported on the base frame or the upper frame, the first arm including first, second, and third connections placed on a first straight line in order, and a fourth connection positioned on a second straight line which is inclined by a predetermined angle with respect to the first straight line from the second connection;

a second arm including fifth and sixth connections, and a seventh connection positioned on a fourth straight line which is inclined by a predetermined angle with respect to a third straight line connecting the fifth and sixth connections, the fourth straight line passing through the sixth connection; and a fifth arm connected to the fourth connection of the first arm, the second connection of the first arm and the sixth connection of the second arm are rotatably connected, a linear actuator has one end connected to the fifth connection and the other end connected to the seventh connection of the second arm, and by driving the link mechanism with using the linear actuator, the upper frame is relatively lifted and lowered with respect to the base frame.

BRIEF DESCRIPTION OF THE DRAWINGS

These and other aspects and features of the present invention will become clear from the following description taken in conjunction with the embodiments thereof with reference to the accompanying drawings, in which.

DESCRIPTION OF THE EMBODIMENTS

Figure 1A:
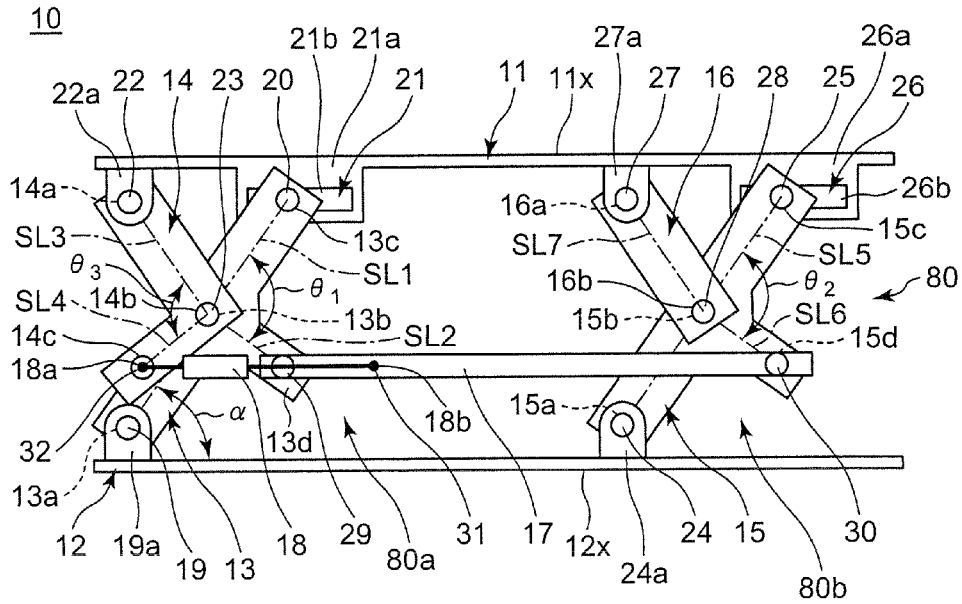
FIG. 1A is a configuration view of a lifting apparatus in an embodiment of the present invention.

Hereinafter, an embodiment of the present invention will be described with reference to the drawings. It should be noted that the same constituent elements will be given the same reference numerals, and description thereof will be omitted in some cases. For easy understanding, the drawings are schematic focusing on the constituent elements.

Embodiment

Figure 1B:
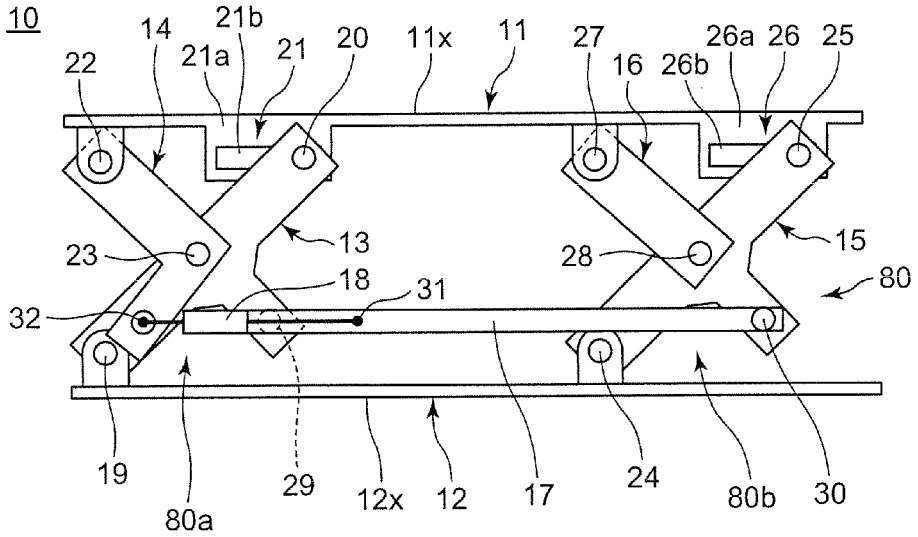
FIG. 1B is a configuration view of the lifting apparatus in the embodiment of the present invention.
Figure 2:
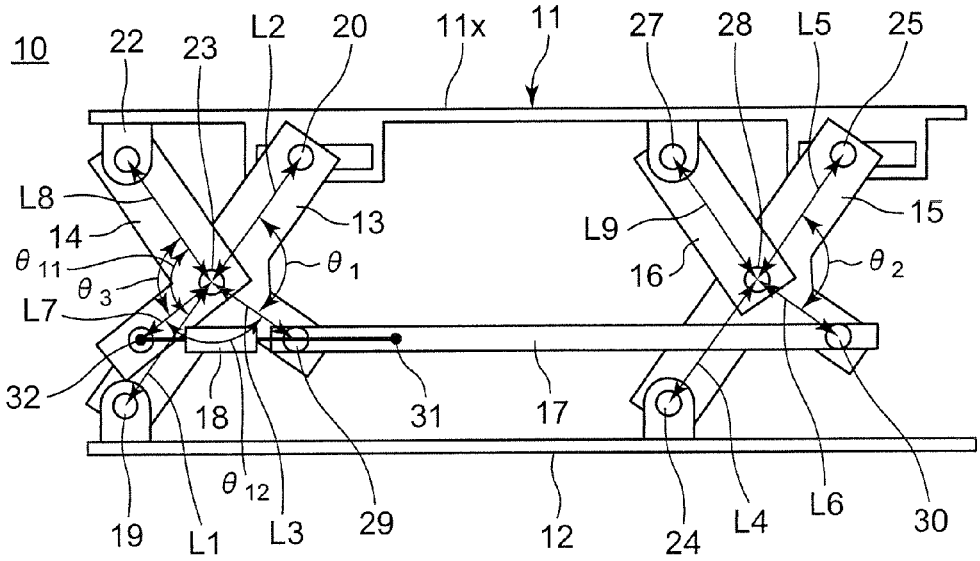
FIG. 2 is a view showing size definition of the lifting apparatus in the embodiment.

FIG. 1A is a configuration view of a lifting state of a lifting apparatus 10 according to one embodiment of the present invention. FIG. 1B is a configuration view of a lowering state of the lifting apparatus 10, and FIG. 2 is a view showing size definition of the lifting apparatus 10.

As shown in FIGS. 1A and 13, the lifting apparatus 10 of the embodiment is a lifting apparatus for lifting and lowering an upper frame 11 with respect to a base frame 12. This lifting apparatus 10 includes at least the base frame 12, the upper frame 11, a linear actuator 18, and a link mechanism 80.

The link mechanism 80 includes a first arm 13, a second arm 14, a third arm 15, a fourth arm 16, and a fifth arm 17 as one example. The first arm 13 is one example of a driving side T-shaped arm, and the second arm 14 is one example of a driving side L-shaped arm. The third arm 15 is one example of a driven side T-shaped arm, the fourth arm 16 is one example of a driven side I-shaped arm, and the fifth arm 17 is one example of a rod shape conjunction arm.

The upper frame 11 includes a first protruding portion 22*a* fixed to a front end thereof, a second protruding portion 21*a* fixed in the vicinity of the first protruding portion 22*a*, a third protruding portion 27*a* fixed to a portion behind the second protruding portion 21*a*, and a fourth protruding portion 26*a* fixed in the vicinity of a portion behind the third protruding portion 27*a* and in a rear end of the upper frame. The second protruding portion 21*a* has a groove 21*b* extending in the longitudinal direction parallel to the upper frame 11. By disengageably engaging a first pivot point 20 to be described later into the groove 21*b* so that the first pivot point 20 can move slidably in the groove 21*b*, a slide guide 21 is formed. The first pivot point 20 is, for example, a driving side upper slide pivot point (support axis). The fourth protruding portion 26*a* has a groove 26*b* extending in the longitudinal direction parallel to the upper frame 11. By disengageably engaging a seventh pivot point 25 to be described later into the groove 26*b* so that the seventh pivot point 25 can move slidably in the groove 26*b*, a slide guide 26 is formed. The seventh pivot point 25 is, for example, a driven side upper slide pivot point (support axis).

The base frame 12 is arranged so as to face the upper frame 11. The base frame 12 includes a fifth protruding portion 19*a* fixed so as to face the first protruding portion 22*a* of the upper frame 11, and a sixth protruding portion 24*a* fixed so as to face the third protruding portion 27*a* of the upper frame 11. Therefore, a mounting surface 12*x* of the base frame 12 and a loading surface 11*x* of the upper frame 11 are arranged so as to be vertical to a straight line connecting a second pivot point 19 and a third pivot point 22 to be described later. The mounting surface 12*x* of the base frame 12 and the loading surface 11*x* of the upper frame 11 are arranged so as to be vertical to a straight line connecting an eighth pivot point 24 and a ninth pivot point 27 to be described later. The second pivot point 19 is, for example, a driving side lower fixed pivot point (support axis). The third pivot point 22 is, for example, a driving side upper fixed pivot point (support axis). The eighth pivot point 24 is, for example, a driven side lower fixed pivot point (support axis). The ninth pivot point 27 is, for example, a driven side upper fixed pivot point (support axis). The loading surface 11*x* is, for example, a lifting item contact surface for loading a lifting item.

As shown in FIGS. 1A and 1B, when seen from a side surface, the upper frame 11 is arranged in parallel with the base frame 12. In detail, when seen from the side surface, the loading surface 11*x* of the upper frame 11 is arranged in parallel with the mounting surface 12*x* of the base frame 12.

The link mechanism 80 is arranged between the upper frame 11 and the base frame 12. The link mechanism 80 is formed by various arms (the first arm 13, the second arm 14, the third arm 15, the fourth arm 16, and the fifth arm 17). This link mechanism 80 functions as one example of a link mechanism, and lifts and lowers the upper frame 11 with respect to the base frame 12.

The link mechanism 80 is formed by a first link mechanism 80*a* and a second link mechanism 80*b*. The first link mechanism 80*a* is, for example, a driving side link mechanism, and the second link mechanism 80*b* is, for example, a driven side link mechanism.

The first link mechanism 80*a* is formed by at least the first arm 13 and the second arm 14. The second link mechanism 80*b* is formed by at least the third arm 15 and the fourth arm 16. The first arm 13 and the third arm 15 each are one example of a T-shaped arm. The second arm 14 is one example of an L-shaped arm. The fourth arm 16 is one example of an I-shaped arm.

The T-shaped arm is provided with connections at four points. The connections at four points of the T-shaped arm are connections at three points placed on a first straight line, and an offset connection at one point positioned on a second straight line which is inclined by a predetermined angle with respect to the first straight line from the center connection.

Connections at four points of the first arm 13 are a first connection 13*a*, a second connection 13*b*, a third connection 13*c*, and a fourth connection 13*d*. Specifically, these connections at four points are connections at three points placed on the first straight line SL1 between an upper end part and a lower end part of the first arm 13 (the first connection 13*a*, the second connection 13*b*, and the third connection 13*c*), and an offset connection (the fourth connection 13*d*) at one point positioned on a second straight line SL2 which is inclined by a predetermined angle θ1 with respect to the first straight line SL1 from the center second connection 13*b*. The first connection 13*a* is the second pivot point 19, the second connection 13*b* is a fourth pivot point 23, the third connection 13*c* is the first pivot point 20, and the fourth connection 13*d* is a fifth pivot point 29.

Connections at four points of the third arm 15 are an eighth connection 15*a*, a ninth connection 15*b*, a tenth connection 15*c*, and an eleventh connection 15*d*. Specifically, these connections at four points are connections at three points placed on a first straight line SL5 between an upper end part and a lower end part of the third arm 15 (the eighth connection 15*a*, the ninth connection 15*b*, and the tenth connection 15*c*), and an offset connection (the eleventh connection 15*d*) at one point positioned on a second straight line SL6 which is inclined by a predetermined angle θ2 with respect to the first straight line SL5 from the center ninth connection 15*b*. The eighth connection 15*a* is the eighth pivot point 24, the ninth connection 15*b* is a tenth pivot point 28, the tenth connection 15*c* is the seventh pivot point 25, and the eleventh connection 15*d* is an eleventh pivot point 30.

The L-shaped arm is provided with connections at three points. The connections at three points of the L-shaped arm are connections at two points, and an offset connection at one point positioned on a fourth straight line which is inclined by a predetermined angle with respect to a third straight line connecting the connections at two points.

Connections at three points of the second arm 14 are a fifth connection 14*a*, a sixth connection 14*b*, and a seventh connection 14*c*. Specifically, these connections at three points are connections (the fifth connection 14*a* and the sixth connection 14*b*) at two points placed on a third straight line SL3 between an upper end part and an intermediate part of the second arm 14, and an offset connection (the seventh connection 14*c*) at one point positioned on a fourth straight line SL4 which is inclined by a predetermined angle θ3 with respect to the third straight line SL3. The fifth connection 14*a* is the third pivot point 22, the sixth connection 14*b* is the fourth pivot point 23, and the seventh connection 14*c* is a sixth pivot point 32.

It should be noted that the L-shaped arm can function as a T-shaped arm by extending a part thereof. Therefore, the L-shaped arm in this embodiment includes the T-shaped arm. For example, although described in detail later, an eighth arm 211 of FIG. 5B is a modification of the second arm 14.

The I-shaped arm is provided with connections at two points in both ends of the longitudinal direction.

The fourth arm 16 is provided with connections at two points in both ends in the longitudinal direction, that is, a twelfth connection 16*a* in an upper end part, and a thirteenth connection 16*b* in a lower end part. The twelfth connection 16*a* is the ninth pivot point 27, and the thirteenth connection 16*b* is the tenth pivot point 28.

The first connection 13*a* serving as the lower end part of the first arm 13 is rotatably connected to the fifth protruding portion 19*a* of the base frame 12 at the second pivot point 19. The third connection 13*c* serving as the upper end part of the first arm 13 is connected to the upper frame 11 slidably by the slide guide 21. Specifically, by disengageably engaging the first pivot point 20 into the groove 21*b* of the second protruding portion 21*a* of the upper frame 11, the third connection 13*c* of the first arm 13 is slidably connected to the upper frame 11.

The fifth connection 14*a* serving as the upper end part of the second arm 14 is rotatably connected to the first protruding portion 22*a* of the upper frame 11 at the third pivot point 22. The sixth connection 14*b* of the second arm 14 is rotatably connected to the second connection 13*b* of the first arm 13 at the fourth pivot point 23. The fourth pivot point 23 is, for example, a driving side arm connection pivot point (support axis).

The eighth connection 15*a* serving as the lower end part of the third arm 15 is rotatably connected to the sixth protruding portion 24*a* of the base frame 12 at the eighth pivot point 24. The tenth connection 15*c* serving as the upper end part of the third arm 15 is connected to the upper frame 11 slidably by the slide guide 26. Specifically, by disengageably engaging the seventh pivot point 25 into the groove 26*b* of the fourth protruding portion 26*a* of the upper frame 11, the tenth connection 15*c* serving as the upper end part of the third arm 15 is slidably connected to the upper frame 11.

The twelfth connection 16*a* serving as the upper end part of the fourth arm 16 is rotatably connected to the third protruding portion 27*a* of the upper frame 11 at the ninth pivot point 27. The thirteenth connection 16*b* serving as the lower end part of the fourth arm 16 is rotatably connected to the ninth connection 15*b* of the third arm 15 at the tenth pivot point 28. The tenth pivot point 28 is, for example, a driven side arm connection pivot point (support axis).

A driving side end part of the fifth arm 17 is rotatably connected to the fourth connection 13*d* of the first arm 13 at the fifth pivot point 29. The fifth pivot point 29 is, for example, a driving side lower coupling arm pivot point (support axis). A driven side end part of the fifth arm 17 is rotatably connected to the eleventh connection 15*d* of the third arm 15 at the eleventh pivot point 30. The eleventh pivot point 30 is, for example, a driven side lower coupling arm pivot point (support axis). An end part 18*b* of the linear actuator 18 is rotatably connected to an actuator fixing portion 31 of the fifth arm 17 in the vicinity of the driving side end part. The actuator fixing portion 31 is positioned between the fifth pivot point 29 and the eleventh pivot point 30.

One end part 18*b* of the linear actuator 18 is rotatably connected to the actuator fixing portion 31 on the fifth arm 17, and the other end part 18*a* is rotatably connected to the seventh connection 14*c* of the second arm 14 at the sixth pivot point 32. The sixth pivot point 32 is, for example, a driving side lower coupling arm pivot point (support axis). The linear actuator 18 is connected to any arms of the link mechanism 80 (the first arm 13, the second arm 14, the third arm 15, the fourth arm 16, and the fifth arm 17), so as to drive to lift and lower the upper frame 11 with respect to the base frame 12.

As shown on the left side of FIG. 2, a distance between center of the second pivot point 19 and center of the fourth pivot point 23 is defined as L1. A distance between center of the first pivot point 20 and the center of the fourth pivot point 23 is defined as L2. A distance between center of the fifth pivot point 29 and the center of the fourth pivot point 23 is defined as L3. A distance between center of the sixth pivot point 32 and the center of the fourth pivot point 23 is defined as L7. A distance between center of the third pivot point 22 and the center of the fourth pivot point 23 is defined as L8. A predetermined angle made by a straight line (part of the first straight line SL1) connecting the center of the first pivot point 20 and the center of the fourth pivot point 23 and a straight line (the second straight line SL2) connecting the center of the fifth pivot point 29 and the center of the fourth pivot point 23 is defined as θ1. A predetermined angle made by a straight line (the third straight line SL3) connecting the center of the sixth pivot point 32 and the center of the fourth pivot point 23 and a straight line (the fourth straight line SL4) connecting the center of the third pivot point 22 and the center of the fourth pivot point 23 is defined as θ3. An angle made by a straight line connecting the third pivot point 22 and the fourth pivot point 23 and a straight line connecting the second pivot point 19 and the fourth pivot point 23 is defined as θ11. An angle made by a straight line connecting the fifth pivot point 29 and the fourth pivot point 23 and a straight line connecting the sixth pivot point 32 and the fourth pivot point 23 is defined as θ12. It should be noted that in the embodiment, the second pivot point 19, the first pivot point 20, and the fourth pivot point 23 are arranged on the same straight line (the first straight line SL1).

Further, as shown on the right side of FIG. 2, a distance between center of the eighth pivot point 24 and center of the tenth pivot point 28 is defined as L4. A distance between center of the seventh pivot point 25 and the center of the tenth pivot point 28 is defined as L5. A distance between center of the eleventh pivot point 30 and the center of the tenth pivot point 28 is defined as L6. A distance between center of the ninth pivot point 27 and the center of the tenth pivot point 28 is defined as L9. A predetermined angle made by a straight line (part of the first straight line SL5) connecting the center of the seventh pivot point 25 and the center of the tenth pivot point 28 and a straight line (the second straight line SL6) connecting the center of the eleventh pivot point 30 and the center of the tenth pivot point 28 is defined as θ2. It should be noted that in the embodiment, the center of the eighth pivot point 24, the center of the seventh pivot point 25, and the center of the tenth pivot point 28 are arranged on the same straight line (the first straight line SL5).

When the inventors variously examined regarding the lifting apparatus 10 formed in such a way, it was found that by setting the configuration of the link mechanism 80 under a predetermined condition, a load applied to the linear actuator 18 by a heavy item loaded on the loading surface 11*x* of the upper frame 11 becomes substantially constant without depending on a position (height) of the upper frame 11. Specifically, it was found that with a triangular-shape formed by the fourth pivot point 23, the second pivot point 19, and the third pivot point 22, and a triangular-shape formed by the fourth pivot point 23, the fifth pivot point 29, and the sixth pivot point 32 as similar shapes in FIG. 2, the load applied to the linear actuator 18 becomes substantially constant without depending on the position (height) of the upper frame 11. Further specifically, it was found that with L1=L8 and L3=L7 and the angle θ11=θ12 in FIG. 2, the load applied to the linear actuator 18 becomes substantially constant without depending on the position (height) of the upper frame 11. It should be noted that at this time, in the link mechanism 80, L1=L2=L8=L4=L5=L9, L3=L7=L6, and the angle θ1=θ2=θ3=90°. In the link mechanism 80 of the embodiment, the triangular-shape formed by the fourth pivot point 23, the second pivot point 19, and the third pivot point 22, and a triangular-shape formed by the tenth pivot point 28, the ninth pivot point 27, and the eighth pivot point 24 have the same shape.

Further, it was found that at this time, as the angle θ1 (=θ3) is more different from 90°, the load applied to the linear actuator 18 in accordance with the position of the upper frame 11 is changed more.

It should be noted that the load applied to the linear actuator 18 is obtained by multiplying the load by the heavy item loaded on the loading surface 11*x* of the upper frame 11 by a constant calculated by L1/L3.

In the embodiment, the triangular-shape formed by the fourth pivot point 23, the sixth pivot point 32, and the fifth pivot point 29, and the triangular-shape formed by the third pivot point 22, the fourth pivot point 23, and the second pivot point 19 are isosceles triangular-shapes having an apex angle of 2α (=θ11=θ12) which are similar shapes. The angle α is an angle made by the loading surface 11*x* of the upper frame 11 or the mounting surface 12*x* of the base frame 12 and L1 or L2 (the first straight line SL1).

The linear actuator 18 is arranged so as to connect the sixth pivot point 32 and the fifth pivot point 29. A change amount of a distance between the sixth pivot point 32 and the fifth pivot point 29 is a drive amount of the linear actuator 18. A distance between the third pivot point 22 and the second pivot point 19 is lifting height, and a change amount of the distance between the third pivot point 22 and the second pivot point 19 is a lifting amount. Therefore, a ratio between the drive amount of the linear actuator 18 and the lifting amount is L1/L3. As a result, the load applied to this lifting apparatus 10 becomes always constant without depending on the angle α.

It should be noted that in the embodiment, positional relationships between the pivot points of the third arm 15 are the same as the first arm 13 with L1=L4, L2=L5, L3=L6, and θ1=θ2. Regarding the second arm 14 and the fourth arm 16, L8=L9.

Figure 3:
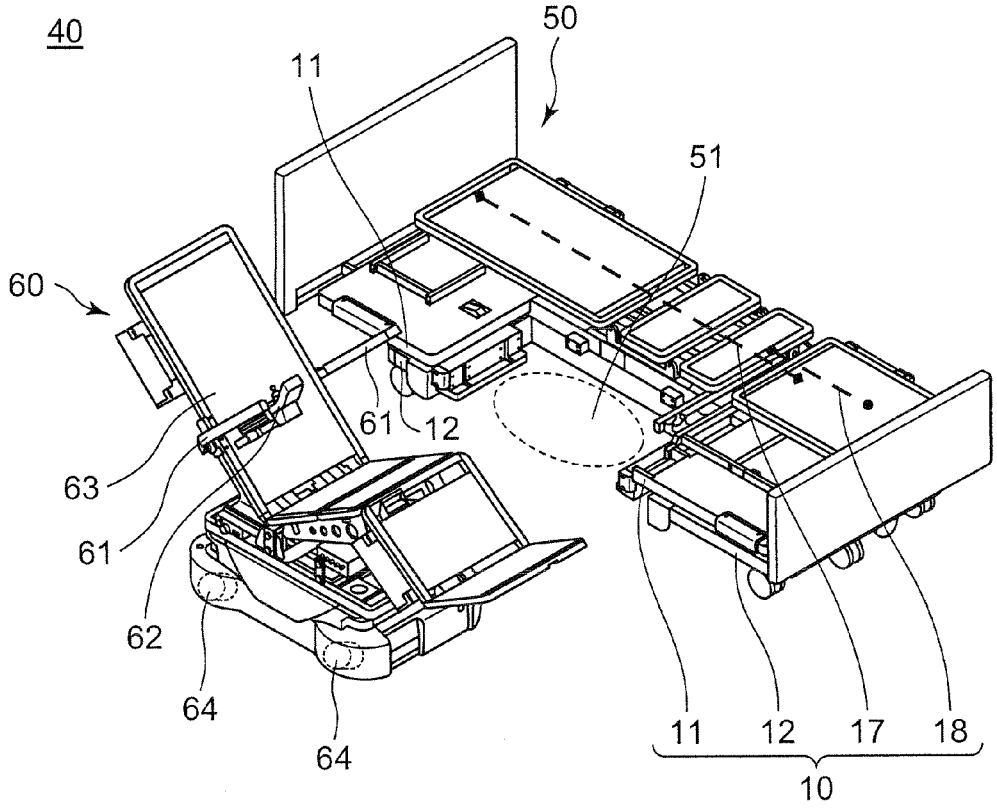
FIG. 3 is a perspective view showing a separation state of a separation type bed in which the lifting apparatus of the embodiment is used.
Figure 4A:
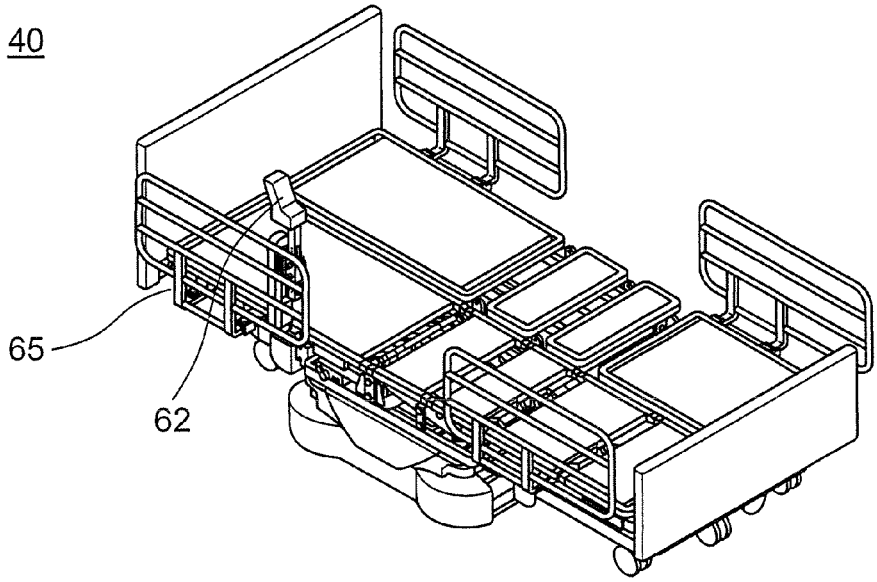
FIG. 4A is a perspective view showing a bed state of the separation type bed in which the lifting apparatus of the embodiment is used.
Figure 4B:
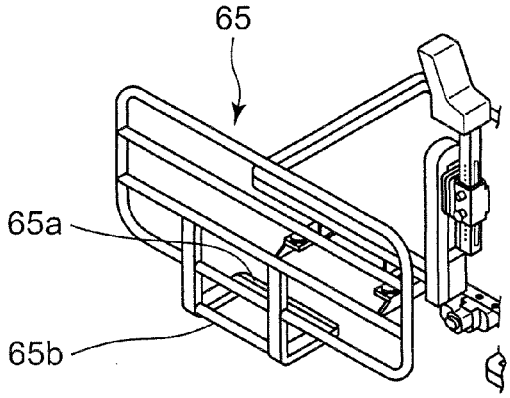
FIG. 4B is a detailed segmentary view of the bed state of the separation type bed of the embodiment.
Figure 4C:
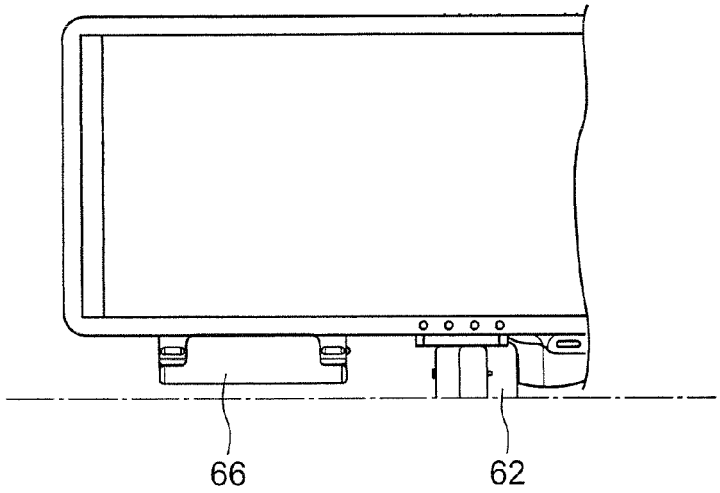
FIG. 4C is a segmentary plan view of the bed state of the separation type bed in the embodiment.

FIG. 3 is a perspective view of a separation type bed 40 in which the lifting apparatus 10 of the embodiment is used. FIG. 4A is a perspective view of the time when the separation type bed 40 is deformed into a bed state. FIG. 4B is an enlarged segmentary view in the perspective view of the separation type bed 40. FIG. 4C is an enlarged segmentary view in a plan view of the separation type bed 40.

As shown in FIG. 3, the separation type bed 40 is formed by a bed unit 50 and a wheelchair unit 60.

The bed unit 50 includes the above lifting apparatus 10 inside thereof, and is formed in such a manner that a support member in an upper part of the bed unit 50 is lifted and lowered by the lifting apparatus 10 with respect to a base of the bed unit 50. The support member of the bed unit 50 is a member for supporting a mattress or the like on which a user lies. The wheelchair unit 60 is stored in a storage space 51 provided in a part on one side in the width direction in the bed unit 50 so as to form the bed state. In this bed state, the wheelchair unit 60 is lifted and lowered together with the upper frame 11 by the lifting apparatus 10. In the bed unit 50, the fifth arm 17 and the linear actuator 18 are arranged only on one side (on the far side in FIG. 3) in the width direction of the bed unit 50 but not arranged on the other side (on the near side in FIG. 3) in the width direction of the bed unit 50 where the storage space 51 is provided. With such a configuration, the large storage space 51 is ensured in the bed unit 50.

The wheelchair unit 60 includes two armrests 61, an operation unit 62 provided in a front end of one of the armrests 61 (on the side opposite to the bed unit 50 at the time of combination), a seat unit 63 to be deformed from a chair form into a flat form by an input of the operation unit 62, and four wheels 64 for moving the wheelchair unit 60.

The separation type bed 40 of the embodiment can be deformed from a separated state in which the bed unit 50 and the wheelchair unit 60 are separated into the bed state in which the bed unit 50 and the wheelchair unit 60 are combined and the entire surfaces of the bed unit 50 and the wheelchair unit 60 are brought into a flat form, by moving the wheelchair unit 60 to the storage space 51 by the input of the operation unit 62 by an operator, and then bringing the seat unit 63 into a flat form. As shown in FIG. 4A, the separation type bed 40 deformed into the bed state integrally lifts and lowers the bed unit 50 and the wheelchair unit 60 at the same time by the lifting apparatus 10 provided inside thereof.

Side rails 65 are installed on side surfaces of the separation type bed 40, and the user can be prevented from falling from the side surfaces of the separation type bed 40 by the side rails 65. As shown in FIGS. 4B and 4C, the side rails 65 are inserted into side rail holders 66 provided in the bed unit 50 and the wheelchair unit 60 from the side.

Figure 5A:
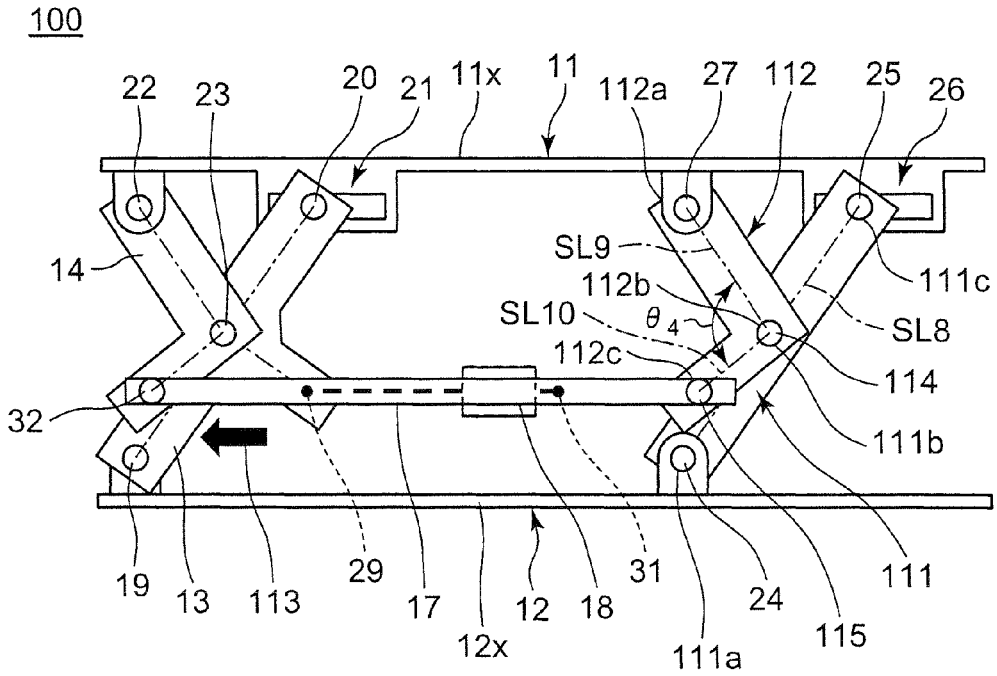
FIG. 5A is a view showing a lifting apparatus of a first different configuration in the embodiment.
Figure 5B:
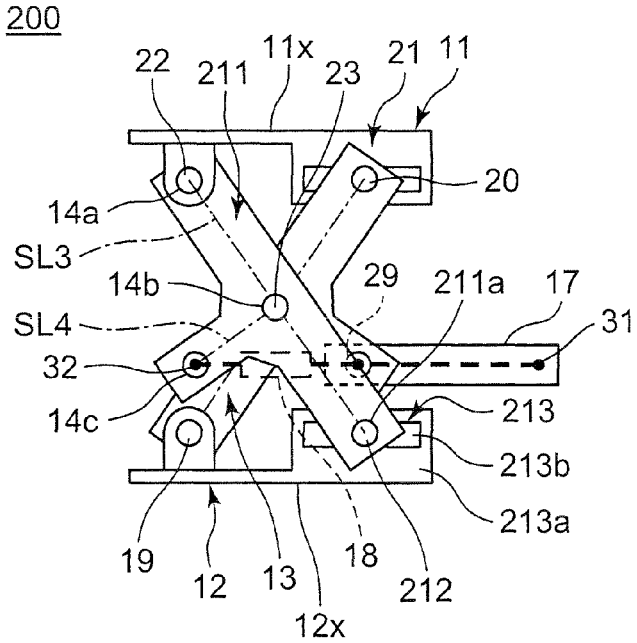
FIG. 5B is a view showing a lifting apparatus of a second different configuration in the embodiment.
Figure 6:
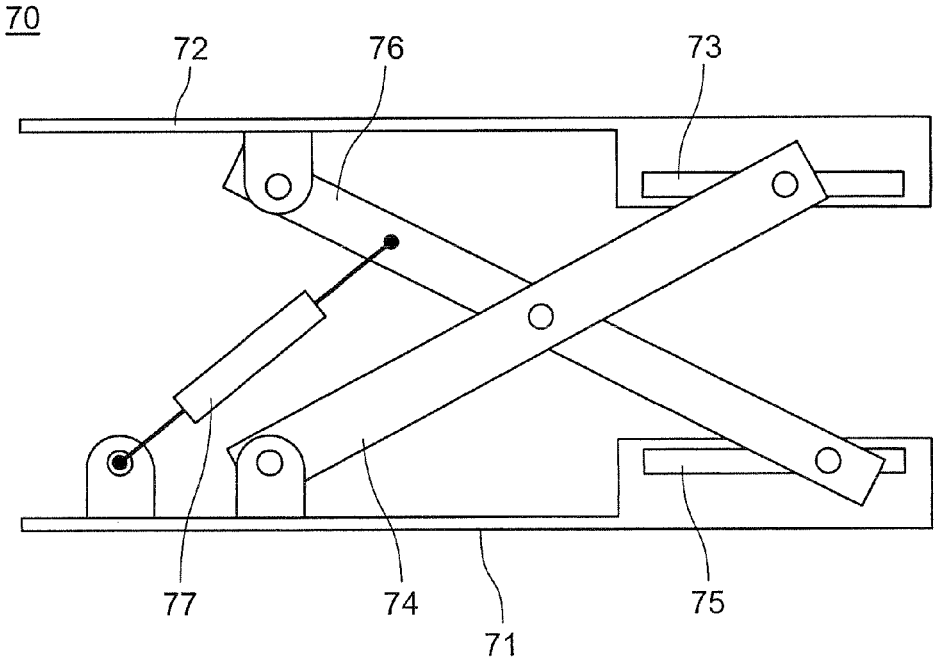
Fig. 6 PRIOR ART
FIG. 6 is a configuration view of a conventional lifting apparatus.

FIG. 5A is a configuration view of a lifting apparatus 100 serving as a different configuration of the lifting apparatus 10 and a first different configuration of the embodiment. FIG. 5B is a configuration view of a lifting apparatus 200 serving as a different configuration of the lifting apparatus 10 and a second different configuration of the embodiment.

As shown in FIG. 5A, the lifting apparatus 100 serving as the first different configuration of the embodiment includes an upper frame 11, a base frame 12, a first arm 13, a second arm 14, a sixth arm 111, a seventh arm 112, a fifth arm 17, and a linear actuator 18. That is, the lifting apparatus 100 serving as the first different configuration has a different driven side arm configuration from the above lifting apparatus 10. The second arm 14 and the seventh arm 112 are respectively one example of the L-shaped arm, and the sixth arm 111 is one example of the I-shaped arm. The first arm 13 and the second arm 14 are a first link mechanism. The sixth arm 111 and the seventh arm 112 are a second link mechanism. The sixth arm 111 has a fourteenth connection 111*a*, a fifteenth connection 111*b*, and a sixteenth connection 111*c* in order on one straight line SL8 obliquely upward from the lower side. The seventh arm 112 has a seventeenth connection 112*a* and an eighteenth connection 112*b* arranged in order obliquely downward from the upper side, and a nineteenth connection 112*c* positioned on a straight line SL10 which is inclined by a predetermined angle θ4 with respect to a straight line SL9 connecting the seventeenth connection 112*a* and the eighteenth connection 112*b*, the straight line passing SL10 through the eighteenth connection 112*b*. The angle θ4 is the same angle as the angle θ3.

The fifteenth connection 111*b* of the sixth arm 111 and the eighteenth connection 112*b* of the seventh arm 112 are rotatably connected at a fourteenth pivot point 114. In the lifting apparatus 100, a sixth pivot point 32 of the second arm 14 and a thirteenth pivot point 115 of the seventh arm 112 are connected by the fifth arm 17. An actuator fixing portion 31 on the fifth arm 17 and a fifth pivot point 29 of the first arm 13 are connected by the linear actuator 18.

In the lifting apparatus 100 of the first different configuration, lengths of the arms are the same i.e. the straight line SL8=the straight line SL5, the straight line SL9=the straight line SL7, and the straight line SL10=the straight line SL4. Therefore, a triangular-shape formed by a fourth pivot point 23, a second pivot point 19, and a third pivot point 22, and a triangular-shape formed by the fourteenth pivot point 114, a ninth pivot point 27, and an eighth pivot point 24 have the same shape. A triangular-shape formed by the fourth pivot point 23, the sixth pivot point 32, and the third pivot point 22, and a triangular-shape formed by the fourteenth pivot point 114, the ninth pivot point 27, and the thirteenth pivot point 115 have the same shape.

Regarding the fifth pivot point 29 or the sixth pivot point 32, the direction of the pivot point not connected to the linear actuator 18 with respect to the pivot point connected to the linear actuator 18 is defined as a determination direction 113. By arranging the actuator fixing portion 31 of the lifting apparatus 100 in the opposite direction to the determination direction 113 with respect to the pivot point connected to the linear actuator 18, the direction of a load applied to the linear actuator 18 in the lifting apparatus 100 is reversed from the load applied to the linear actuator 18 in the above lifting apparatus 10, so that a tensile load is added. As a result, the lifting apparatus 100 of the first different configuration is particularly effective in a case where the linear actuator 18 has a favorable characteristic with respect to tension.

As shown in FIG. 5B, the lifting apparatus 200 serving as the second different configuration of the embodiment is formed by an upper frame 11, a base frame 12, a first arm 13, an eighth arm 211, a fifth arm 17, and a linear actuator 18. That is, the lifting apparatus 200 serving as the second different configuration has only a driving side arm configuration without a driven side arm configuration, and has a different driving side arm configuration from the above lifting apparatus 10. Each of the first arm 13 and the eighth arm 211 is one example of the T-shaped arm. The eighth arm 211 is the modification of the second arm 14.

In the lifting apparatus 200, the eighth arm 211 is connected to other members at a third pivot point 22, a twelfth pivot point 212, a fourth pivot point 23, and a sixth pivot point 32. Specifically, the eighth arm 211 is rotatably coupled to the upper frame 11 at the third pivot point 22, slidably connected to a slide guide 213 provided in the base frame 12 at the twelfth pivot point 212, and rotatably coupled to the first arm 13 at the fourth pivot point 23. The slide guide 213 has a similar structure to the slide guide 21. That is, the base frame 12 has a fixed protruding portion 213*a*, the protruding portion 213*a* has a groove 213*b* extending in the longitudinal direction, and the twelfth pivot point 212 is disengageably engaged into the groove 213*b* so as to be slidably movable, thereby forming the slide guide 213. The twelfth pivot point 212 is, for example, a driving side lower slide pivot point (support axis). The fifth arm 17 is rotatably connected to a fifth pivot point 29 of the first arm 13.

In the lifting apparatus 200 of the second different configuration, a triangular-shape formed by the fourth pivot point 23, a second pivot point 19, and the third pivot point 22, and a triangular-shape formed by the fourth pivot point 23, a fifth pivot point 29, and the sixth pivot point 32 are similar shapes. In the second different configuration, when the sum of an angle ($\theta 1$) made by a segment (first straight line) connecting the second pivot point 19 and a first pivot point 20 and a segment (second straight line) connecting the fourth pivot point 23 and the fifth pivot point 29, and an angle ($\theta 3$) made by a segment (third straight line) connecting the third pivot point 22 and the twelfth pivot point 212 and a segment (fourth straight line) connecting the fourth pivot point 23 and the sixth pivot point 32 is 180°, a load applied to the linear actuator 18 by a heavy item loaded on a loading surface 11*x* of the upper frame 11 can be substantially constant without depending on a distance between the upper frame 11 and the base frame 12. That is, in the second different configuration, with $\theta 1+\theta 3=180°$, the load applied to the linear actuator 18 can be constant.

In the lifting apparatus 200, by connecting the linear actuator 18 to the sixth pivot point 32 of the eighth arm 211 and an actuator fixing portion 31 of the fifth arm 17, the load applied to the linear actuator 18 by the heavy item loaded on the loading surface 11*x* of the upper frame 11 can be substantially constant without depending on the distance between the upper frame 11 and the base frame 12.

According to the above embodiment, the lifting apparatus in which the load applied to the linear actuator 18 becomes constant without depending on the distance between the upper frame 11 and the base frame 12, and the bed provided with the same can be provided.

By appropriately combining arbitrary embodiments or modifications among the above various embodiments and modifications, effects provided in the embodiments or the modifications can be obtained.

It should be noted that although the example of the bed provided with the lifting apparatus is described in the embodiment, the lifting apparatus of the present invention can be utilized for various devices provided with a lifting device in addition to the bed.

The lifting apparatus according to the present invention and the bed provided with the same are particularly useful for a nursing care bed for lifting and lowering a care-receiver within a wide range, and useful in an ordinary house, a hospital facility, or a nursing care facility where the care-receiver in need of care resides.

Although the present invention has been fully described in connection with the embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A lifting apparatus comprising a link mechanism lifting and lowering an upper frame with respect to a base frame, wherein the link mechanism comprises:

a first arm slidably supported on the base frame or the upper frame, the first arm including first, second, and third connections placed on a first straight line in order, and a fourth connection positioned on a second straight line which is inclined by a predetermined angle with respect to the first straight line from the second connection;

a second arm including fifth and sixth connections, and a seventh connection positioned on a fourth straight line which is inclined by a predetermined angle with respect to a third straight line connecting the fifth and sixth connections, the fourth straight line passing through the sixth connection; and a fifth arm connected to the fourth connection of the first arm, the second connection of the first arm and the sixth connection of the second arm are rotatably connected, a linear actuator has one end connected to the fifth connection and the other end connected to the seventh connection of the second arm, by driving the link mechanism with using the linear actuator, the upper frame is relatively lifted and lowered with respect to the base frame, the link mechanism further comprises:

a first link mechanism on a driving side connected to the linear actuator, the first link mechanism including the first arm and the second arm; and a second link mechanism on a driven side, the fifth arm connects the first link mechanism and the second link mechanism, and the second link mechanism comprises:

a T-shaped third arm slidably supported on the base frame or the upper frame, the third arm including eighth, ninth, and tenth connections placed on a fifth straight line in order, and an eleventh connection positioned on a sixth straight line which is inclined by a predetermined angle with respect to the fifth straight line from the ninth connection; and an I-shaped fourth arm including twelfth and thirteenth connections, and the ninth connection of the third arm and the thirteenth connection of the fourth arm are rotatably connected.

2. The lifting apparatus according to claim 1, wherein
a triangular-shape formed by the second connection, the fifth connection, and the first connection, and a triangular-shape formed by the second connection, the fourth connection, and the seventh connection are similar shapes.

3. The lifting apparatus according to claim 2, wherein
the first arm is a T-shaped arm, and
the second arm is an L-shaped arm.

4. The lifting apparatus according to claim 2, wherein
the second connection is positioned in center of a segment connecting the first connection and the third connection.

5. The lifting apparatus according to claim 2, wherein
the second link mechanism comprises:
a sixth arm including fourteenth, fifteenth, and sixteenth connections; and
a seventh arm including seventeenth and eighteenth connections, and a nineteenth connection positioned on a seventh straight line which is inclined by a predetermined angle with respect to an eighth straight line connecting the seventeenth and eighteenth connections, the seventh straight line passing through the eighteenth connection, and
the fifteenth connection of the sixth arm and the eighteenth connection of the seventh arm are rotatably connected.

6. The lifting apparatus according to claim 2, wherein
the link mechanism comprises the first arm, and a T-shaped sixth arm formed on the third straight line connecting the fifth and sixth connections in the second arm and extended so as to have another connection on an opposite side of the fifth connection with respect to the sixth connection.

7. The lifting apparatus according to claim 2, wherein
the predetermined angle is 90°.

8. The lifting apparatus according to claim 2, wherein
a sum of an angle made by the first straight line and the second straight line, and an angle made by the third straight line and the fourth straight line is 180°.

9. A bed, comprising:
the lifting apparatus according to claim 2; and
a bed unit to be lifted and lowered by the lifting apparatus.

10. The lifting apparatus according to claim 1, wherein
the first arm is a T-shaped arm, and
the second arm is an L-shaped arm.

11. The lifting apparatus according to claim 1, wherein
the second connection is positioned in center of a segment connecting the first connection and the third connection.

12. The lifting apparatus according to claim 1, wherein
the predetermined angle is 90°.

13. The lifting apparatus according to claim 1, wherein
a sum of an angle made by the first straight line and the second straight line, and an angle made by the third straight line and the fourth straight line is 180°.

14. A bed, comprising:
the lifting apparatus according to claim 1; and
a bed unit to be lifted and lowered by the lifting apparatus.

15. A lifting apparatus according to claim 1, comprising a link mechanism lifting and lowering an upper frame with respect to a base frame, wherein
the link mechanism comprises:
a first arm slidably supported on the base frame or the upper frame, the first arm including first, second, and third connections placed on a first straight line in order, and a fourth connection positioned on a second straight line which is inclined by a predetermined angle with respect to the first straight line from the second connection;
a second arm including fifth and sixth connections, and a seventh connection positioned on a fourth straight line which is inclined by a predetermined angle with respect to a third straight line connecting the fifth and sixth connections, the fourth straight line passing through the sixth connection; and
a third arm connected to the fourth connection of the first arm,
the second connection of the first arm and the sixth connection of the second arm are rotatably connected,
a linear actuator has one end connected to the fifth connection and the other end connected to the seventh connection of the second arm,
by driving the link mechanism with using the linear actuator, the upper frame is relatively lifted and lowered with respect to the base frame, and
the link mechanism comprises the first arm, and a T-shaped fourth arm formed on the third straight line connecting the fifth and sixth connections in the second arm and extended so as to have another connection on an opposite side of the fifth connection with respect to the sixth connection.

* * * * *